United States Patent [19]

Hopper

[11] 4,368,771

[45] Jan. 18, 1983

[54] MOVABLE INSULATION APPARATUS

[76] Inventor: Thomas P. Hopper, R.R. #1, Box 689, Blue Hills Rd., Durham, Conn. 06422

[21] Appl. No.: 270,627

[22] Filed: Jun. 4, 1981

[51] Int. Cl.[3] ..... E06B 9/08

[52] U.S. Cl. ..... 160/121 R

[58] Field of Search ..... 160/120–122, 160/241

[56] References Cited

U.S. PATENT DOCUMENTS

| | | | |
|---|---|---|---|
| 1,442,255 | 1/1923 | Doner | 160/121 |
| 2,341,123 | 2/1944 | Schweller | 160/120 |
| 4,039,019 | 8/1977 | Hopper | 160/121 |
| 4,151,871 | 5/1979 | Ryan | 160/120 |
| 4,187,896 | 2/1980 | Shore | 160/121 |
| 4,275,645 | 6/1981 | Ruff | 160/120 |

*Primary Examiner*—Peter M. Caun

*Attorney, Agent, or Firm*—Fitzpatrick, Cella, Harper & Scinto

[57] ABSTRACT

Movable insulation apparatus is disclosed for selectably covering and uncovering an opening, such as a window to control the amounts of heat energy and light transmitted through the opening. The opening has a foot, a head situated above the foot, and height and width. The movable insulation apparatus comprises at least one sheet having a leading and a trailing end, width at least equal to the width of the opening and length at least equal to twice the height of the opening. A retracting roller is mounted rotatably to span the width of the opening at the foot. The trailing end of the sheet is attached to the roller and the leading end of the sheet is secured in the region of the foot of the opening. A motor urges the roller in one angular direction to roll the sheet thereon. A supporting device for supporting the sheet intermediate its ends, spans the width of the opening, and is mounted for reciprocal movement between an open position in the region of the foot, in which the sheet is retracted onto the roller to uncover the opening, and a closed position in the region of the head of the opening in which the sheet is drawn to cover the opening. The sheet passes around the support device to define two sheet layers extending in spaced relation between the foot and the support rod. Additional sheets may be included, in which case the support device is equipped with structure to space all sheet layers apart, to define a dead air space between each pair of such layers. The support is further mounted for pivoted movement about its horizontal axis to accommodate limited movement of the sheet therearound and prevent abrasion of the sheet. A frame is also provided to prevent air flow from occurring past the sheet layers to the opening when the support device is in the closed position. This movable insulation apparatus provides high thermal resistance when fully closed and even when partially opened.

45 Claims, 16 Drawing Figures

MOVABLE INSULATION APPARATUS

BACKGROUND OF THE INVENTION

1. Field of the Invention

The present invention relates to movable insulation apparatus for insulating against radiant, conductive and convective heat transmission through building openings such as windows, doors, and the like. The movable insulation apparatus is designed for selectable movement to cover and uncover the opening and thereby control the amount of heat energy and light transmitted therethrough.

In recent years conservation of energy has become a subject of great national concern. As readily available and now technologically feasible sources of energy become more scarce or more expensive, the need to conserve energy from such sources becomes more acute.

A primary target for conservation efforts is energy used to control building temperatures. Indeed, it has been estimated that the heating and cooling systems of residential, industrial, and commercial buildings use approximately 25% of all energy consumed in the United States. Transparent single pane or double insulated pane windows in such buildings, however, are very poor insulators and, therefore, can lead to inefficient and thus excessive consumption of energy for building heating and cooling purposes. For example, it has further been found that in winter, the heat loss per unit area through conventional windows is typically three to ten times as great as that through adjacent walls, depending upon the type of insulation in the wall. Similarly, in summer the total heat entering through a sunlit window may be more than ten times that through the adjacent wall. (Se ASHRAE, *Handbook of Fundamentals* (1972); R. C. Dix and Z. Lavan, "Window Shades and Energy Conservation", Mechanics, Mechanical and Aerospace Engineering Department, Illinois Instititue of Technology, (1974)). Therefore, substantial amounts of energy can be saved if window and other glassed areas are effectively insulated. However, it is desirable to do so without permanently blocking such glassed areas in a manner that use of them for ventilation and natural lighting would be prevented.

It is further desirable that insulation for windows and other glassed areas provide high insulation value even when the area is partially opened or exposed by the insulation to allow for entry of light therethrough.

It may also be desirable or advantageous to insulate areas of buildings other than windows where the permissible thickness of insulation is limited.

2. Description of the Prior Art

Various devices have been proposed in the past for insulating windows or other such building openings. For example, U.S. Pat. Nos. 4,039,019 (Hopper) and 4,194,550 (Hopper) disclose highly effective devices that include a plurality of opaque or translucent imperforate shade sheets attached to a retracting roller mounted to horizontally span the building opening at its upper end or head. The sheets may be drawn downwardly from the roller to cover the window or may be retracted upwardly back on to the roller to uncover the window. Thus, in use, these insulating apparatus operate as do conventional window shades being drawn from the top of the window down.

A number of spacer devices are mounted with one sheet of each pair of adjacent sheets to separate those sheets, when they are drawn to cover the window, and thereby define a dead air space therebetween. The spacers are collapsible or nestable so that when the sheets are retracted onto the roller the sheet layers may be tightly compacted to constitute a cylinder having diameter not much greater than a conventional shade. A low emittance surface is associated with at least one of the sheets and faces on one dead air space. The insulating effect of the low emittance surface synergistically combines with the insulating effect of the associated dead air space to yield a substantially higher insulating value than merely the sum of the individual insulating values of the surface and dead air space. It has further been shown that an apparatus having three shade sheets constructed as described above provides eight times, and that an apparatus having five sheets provides sixteen times, greater thermal resistance (R) when drawn over a single pane window, then does the window when uncovered.

U.S. Pat. No. 4,247,599 (Hopper) discloses a composite sheet material having low emittance characteristics that may advantageously be used in the insulating shade apparatus disclosed in the Hopper patents mentioned above.

Other constructions for insulating openings such as windows are disclosed in U.S. Pat. Nos. 2,305,085 (Smith); 2,140,049 (Grauel); 2,328,257 (Butts); 2,865,446 (Cole); 1,908,989 (Lahey et al). U.S. Pat. No. 2,341,123 (Schweller) discloses a refrigerating apparatus that includes a multiple layer closure device. U.S. Pat. No. 3,952,947 (Saunders) discloses a heating and ventilating system which includes a two layer shade device, with each shade layer being retracted on a separate roller. One roller is mounted to be both vertically and horizontally displaced from the other. The top of the shade carried on the one roller is also arranged to be drawn to a location similarly horizontally and vertically displaced from the top of the shade on the other roller. Therefore, air current can flow between the shades from one side of one shade to an opposite side of the other shade and, in fact, the patent teaches that this is desirable. However, air flow between the shades reduces the efficiency of the device in insulating against heat transmission.

FIG. 9-3, page 146 in Wm Langdon, *Movable Insulation* (1980), discloses a reflective single layer window shade mounted between a window and storm sashes to cover a building opening.

While many apparatus have been proposed, including the highly effective apparatus disclosed in the two prior Hopper patents, all such know apparatus are characterized by certain drawbacks. In all such apparatus which are closed by being drawn from the top to the bottom of a building opening or sidewardly across a building opening, it has been found that a major portion of the insulating value is lost when such devices are even slightly opened. Accordingly, in order to open the device to see out through the opening which it insulates, a major portion of the insulating value must be sacrificed.

Known devices which are drawn from the bottom of a building opening upwardly are also characterized by certain drawbacks. For example, as noted above, the apparatus disclosed in the Saunders patent is constructed to encourage flow of air between adjacent sheets that greatly reduces its insulating value. This apparatus is also relatively complicated, requiring at least two of the retracting rollers, on for each of two sheets. The device disclosed in *Movable Insulation* is a single layer shade. The Schweller patent discloses a relatively complicated device having multiple retracting rollers for multiple shade sheets which is believed to be ill suited for wide scale commercial use to insulate building openings.

It is the intent of the present invention to correct certain deficiencies in known prior art apparatus.

SUMMARY OF THE INVENTION

It is an object of the present invention to provide movable insulation apparatus for limiting the amounts of both heat energy and light transmitted through a building opening such as a window or a door.

It is a further object of the present invention to provide movable insulation apparatus for a building opening that has substantial insulation value even when only partially drawn to a closed position. Therefore, this apparatus may be set in a partially open position to admit light into the building yet still provides valuable insulation for the building opening.

It is still a further object of the present invention to provide novel construction for moving the movable insulation apparatus between closed and opened positions and for setting the apparatus in any position therebetween.

It is a further object of the present invention to provide a simple, economically constructed and installed, yet effective movable insulation apparatus that may be put into widespread use.

It is yet another object of the present invention to provide simple, economical, yet effective structure for preventing air currents from developing between the apparatus and the building opening.

In general accordance with the present invention, the movable insulation apparatus may selectably cover or uncover an opening, such as a window, door, or the like, in the wall of the building to control the amounts of both heat and light transmitted through the opening. The opening has a foot, a head situated above the foot, height and width. The movable insulation apparatus comprises a sheet having leading end and a trailing end, width at least equal to the width of the opening and length at least equal to twice the height of the opening. The sheet is preferably provided with at least one low emittance surface.

A retracting roller is rotatably mounted to span the width of the opening at the foot. The trailing end of the sheet is attached to the roller and the leading end of the sheet is secured in the region of the foot.

A motor such as a conventional spring mechanism is provided to urge the roller in one angular direction to roll or retract the sheet thereon. A support bar supports the sheet intermediate its ends and spans the width of the opening. The bar is mounted for reciprocal movement between an open position in the region of the foot, with the sheet rolled on the roller to uncover the opening, and a closed position in the region of the head, with the sheet drawn off of the roller to cover the opening. The sheet passes around the bar to define two sheet layers which extend between the region of the foot and the bar and are spaced apart to define a dead air space therebetween. The bar is further mounted for pivoted movement about its horizontal axis to accommodate movement of the sheet thereon and thereby prevent abrasion of the sheet.

A modular frame constructed of various extruded and molded elements, which may easily be cut as necessary to proper size for a given building opening, is mounted about the periphery of the opening and seals the periphery of the sheet layers to prevent air currents from developing between the layers and the opening.

A flexible yet stiff side sealing panel is mounted to be drawn between the outermost sheet layers to urge them against side sealing walls of the frame to thereby nearly completely enclose the dead air space defined between the sheet layers and prevent air currents from developing therein.

The movable insulation apparatus of the invention may further be equipped with additional sheets to define additional sheet layers, each of which desirably has a low emittance surface. A conveniently constructed and assembled spacer arrangement, which is mounted with the support bar to space such multiple sheet layers apart, provides additional dead air spaces to enhance the insulating value of the apparatus.

A complementary spacer device is mounted in the region of the foot to cooperate with the spacer device mounted with the support bar to further separate at least some of the sheets. This second spacer incorporates a special bearing to prevent abrasion of sheets on it.

It has been found that substantial insulating value is provided by the movable insulation apparatus of the invention whether completely or only partially closed.

For this and other reasons, the movable insulation apparatus of the present invention provides a comprehensive improvement of many of the drawbacks characteristic of previously known insulating apparatus.

These and other objects, features, and advantages of the present invention will be pointed out in or will be understood from the following detailed description provided below in conjunction with the accompanying drawings.

DETAILED DESCRIPTION OF THE PREFERRED EMBODIMENTS

Figure 1:
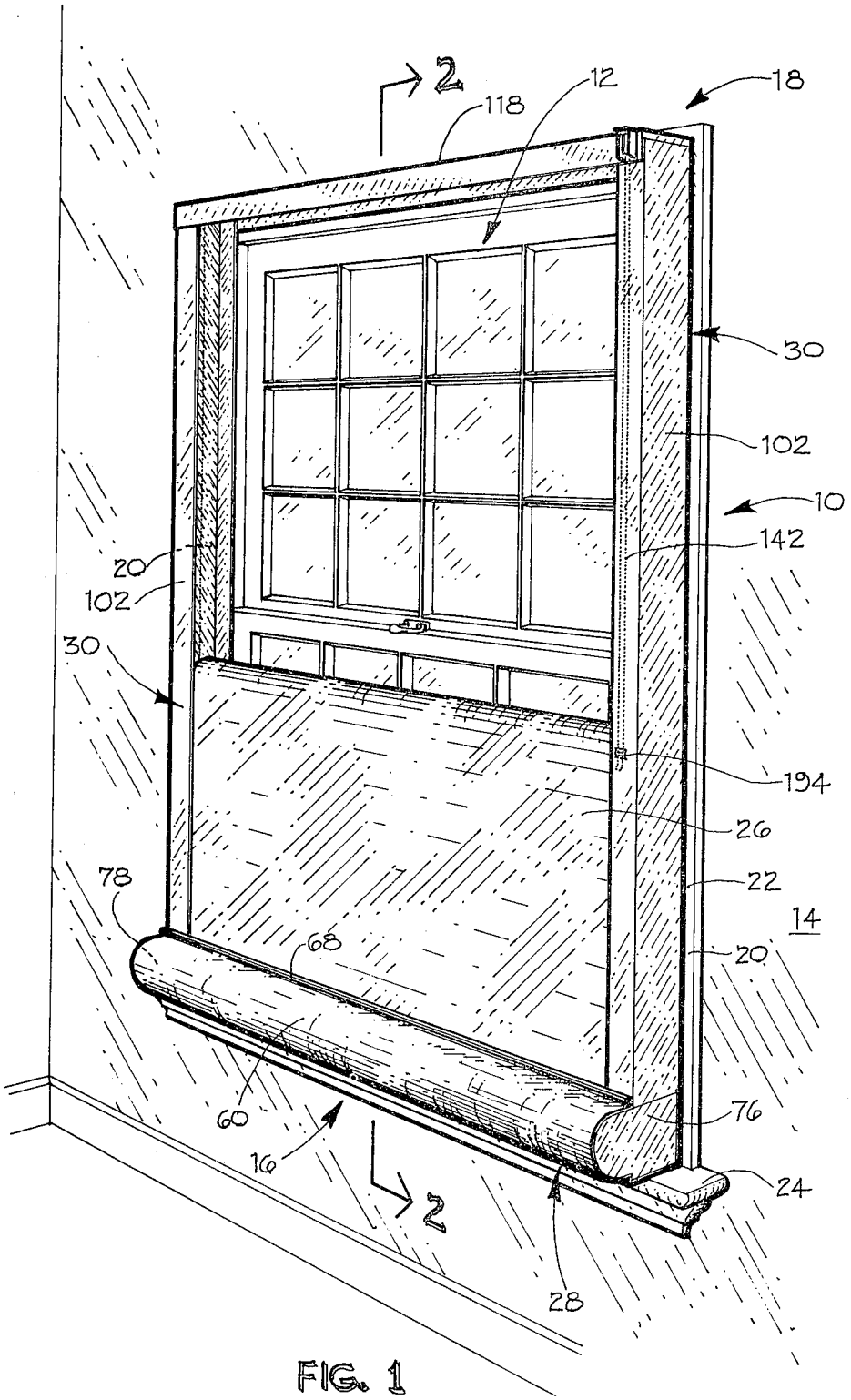
FIG. 1 is a perspective view of the movable insulation apparatus of the present invention mounted to selectably cover and uncover a conventional, double-hung window.

Referring first to FIG. 1, the movable insulation apparatus of the present invention, generally indicated at 10, is mounted to selectably cover and uncover a conventional double-hung window, generally indicated at 12, mounted in a wall 14 of a building. The movable insulation apparatus 10 may be used with equal advantage to insulate other building openings such as doors, skylights, and the like. However, for purposes of this specification, the movable insulation apparatus 10 will be described as used to selectably cover and uncover the window 12.

As can be seen in FIG. 1, the window 12 has a foot 16, a head 18, and two generally vertically extending sides 20. Window molding 22 is secured to the wall 14 about the head and two sides of the window 12, and a sill 24 projects horizontally outwardly at the foot of the window. Accordingly, the window further has both width and height.

As shown in FIG. 1, the principal components of the movable insulation apparatus of the invention include a sheet 26 that may be drawn upwardly from a lower housing, generally indicated at 28, mounted on the sill 24 of the window. Edge portions of the sheet are confined within a frame, generally indicated at 30, of which the housing 28 is a part. This frame minimizes or prevents convection air currents from flowing around the periphery of the sheet 26 to the window 12 when the sheet is drawn to its fully closed or a partially closed position.

Figures 2, 3:
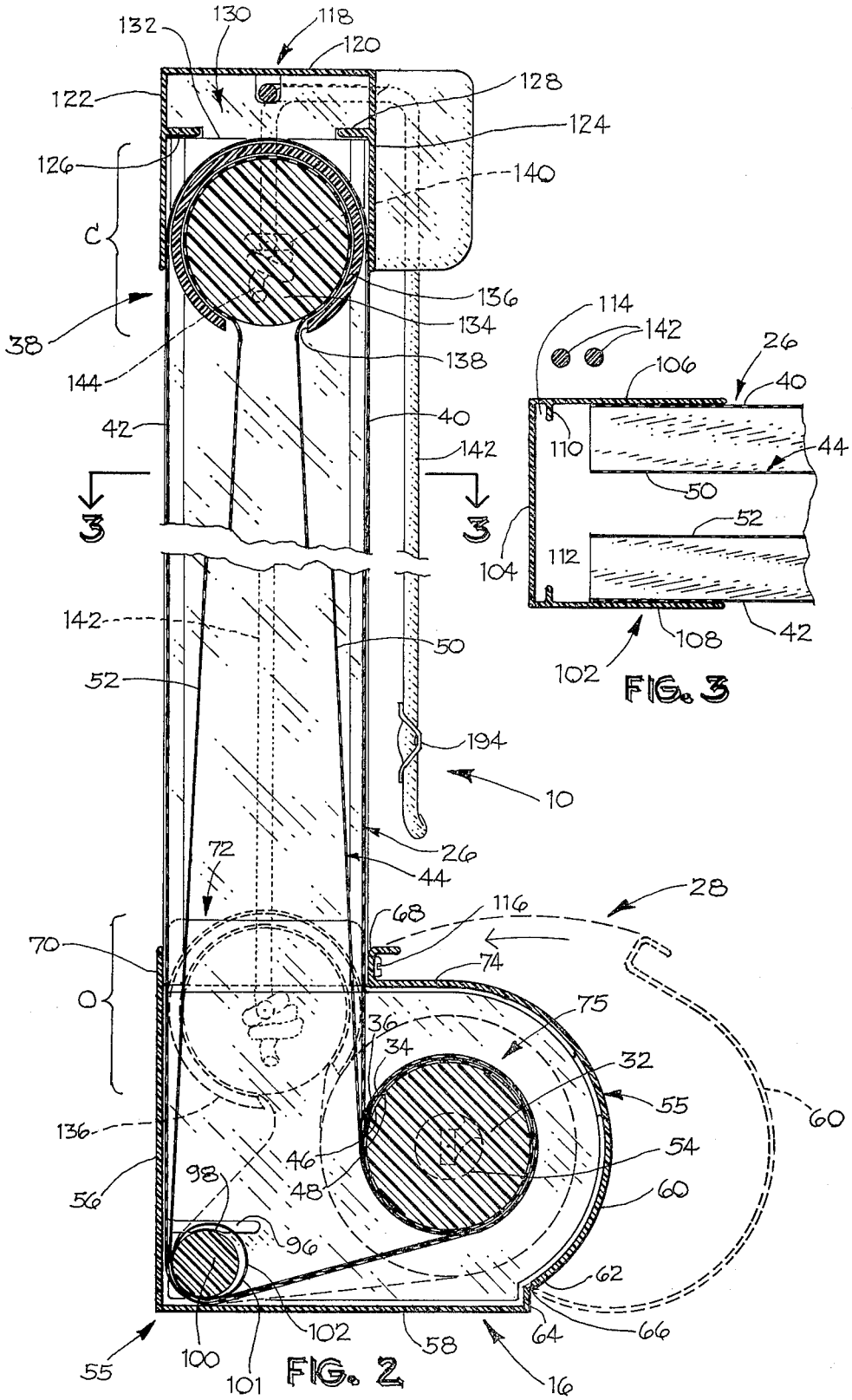
FIG. 2 is a vertical cross-sectional view of the movable insulation apparatus taken through plane 2—2 in FIG. 1 showing the support bar, the spacer arrangement on the support bar, the spacer device at the foot of the opening, and the retracting roller.
FIG. 3 is a horizontal cross-sectional view taken on plane 3—3 in FIG. 2 looking downwardly.

Referring now to FIG. 2, the principal components of the movable insulation apparatus 10 of the invention further include a retracting roller 32 mounted for rotation and horizontally spanning the width of the window at its foot 16. The sheet 25, seen in FIG. 1, has a leading end 34 and a trailing end 36 both of which are secured to the retracting roller 32. This sheet 26 further has width at least equal to the width of the window 12 (See FIG. 1), and length between its ends at least equal to twice the height of the window 12 (see FIG. 2). The sheet 25 is supported intermediate its ends generally above the roller by a support device, generally indicated at 38 and described in greater detail below, to thereby define two sheet layers 40 and 42 that extend in spaced relation from the foot of the opening to the device 38.

The movable insulation of the preferred embodiment also includes a second sheet 44 having leading and trailing ends 46 and 48 secured to the retracting roller 32. This innermost sheet 44 is also supported intermediate its ends by the support device 38, in a manner to be described in greater detail below, to define two sheet layers 50 and 52 confined within the envelope defined by the sheet layers 40 and 42 of the first sheet 26. The support device and a further spacer device mounted at the foot of the window space the respective sheet layers 40, 42, 50 and 52 apart to define a dead air space between adjacent ones of these layers.

The retracting roller houses a conventional spring motor 54 that urges the roller to rotate in a counterclockwise direction as shown in FIG. 2 to retract all sheet layers simultaneously thereon. The support device is mounted for reciprocal movement between closed and open positions respectively shown at C by solid lines and 0 by phantom lines in FIG. 2 and a mechanism is provided to move the support device to its open position against the urging of the spring motor 54.

The details of the principal components of the inventions generally identified above will now be described.

FIGS. 2 through 12 illustrate in detail the frame structure for mounting the retracting roller 32 for rotary movement and for mounting the support device for reciprocal movement as generally described above. More particularly, the frame structure includes the lower housing 28 having a main housing structure 55 formed with a rear wall 56, a bottom wall 58 and a cover 60 joined at a bottom edge 62 to a forward edge 64 of the bottom wall by a flexible hinge 66. Both the rear and bottom walls are planar and are joined to each other to make an angle of approximately 90 degrees. The cover has a generally arcuate cross-sectional shape having an upper wall 74 that extends horizontally toward the rear wall 56 to thereby define an enclosed shielded space 75.

At its edge opposite the bottom edge 62, the cover 60 is also formed with a generally C-shaped sealing lip 68. The upper edge of the rear wall 56 constitutes a complementary sealing lip 70 that together with the lip 68 defines an upwardly open, transversely extending slot 72. The enclosed space 75 in the housing, therefore, lies substantially forwardly of the slot 72 for reasons described below (see FIG. 2). The main housing structure 55, which is desirably extruded continuously from a plastic material or may be made of wood, may be easily cut, for example, with a hack saw to an appropriate length for the width of the window 12.

Figure 4:
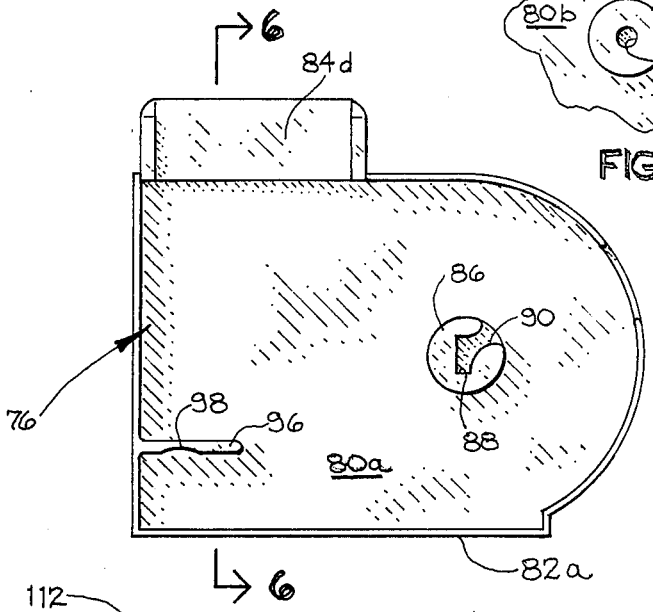
FIG. 4 is a side elevation view of an end cap forming a portion of the frame of the movable insulation apparatus.
Figure 5:
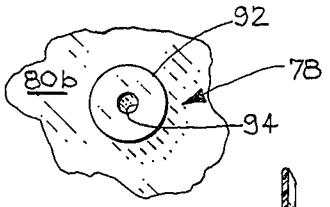
FIG. 5 is a partial side elevational view of another end cap mounted opposite that shown in FIG. 4.
Figure 6:
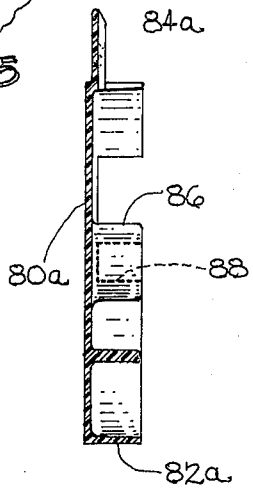
FIG. 6 is a vertical cross-sectional view of the end cap shown in FIG. 4 taken on plane 6—6 looking toward the right.
Figure 7:
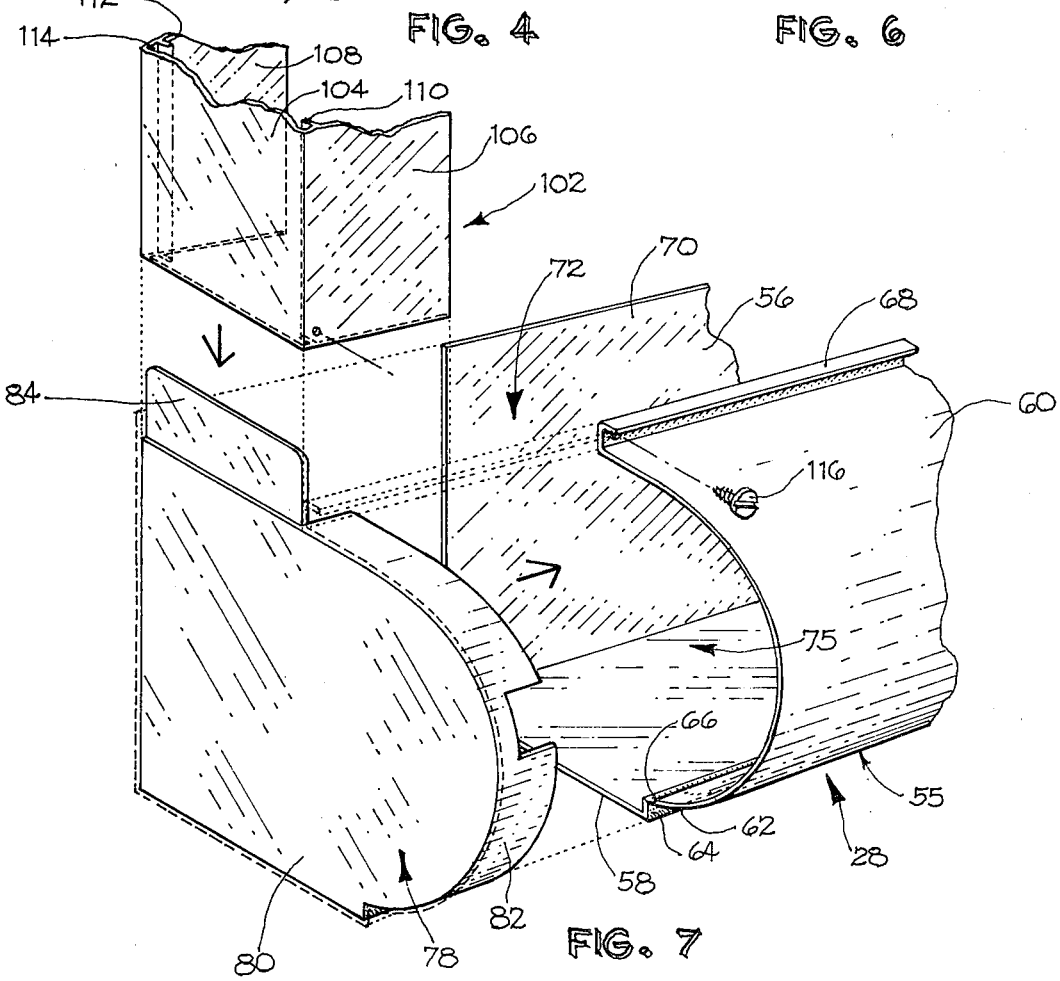
FIG. 7 is a partial perspective view of three components of the frame of a movable insulation apparatus showing how they are assembled together.

As shown in FIGS. 4,5, and 7, housing 28 further includes a pair of end caps 76 and 78 each having a side wall 80*a* or 80*b* a peripheral wall 82 projecting inwardly from the periphery of the side wall 80*a* or 80*b* respectively and an upstanding tab 84 projecting upwardly from an edge of the side wall 80*a* or 80*b* respectively. The peripheral wall 82 of each end cap is shaped to be congruent with and to be received in telescoping relation in an end of the main housing structure 55 when the cover is in its closed position (see FIG. 7). Further, the end cap 76 is formed with an inwardly projecting boss 86 on the inner surface of its side wall 80*a*. The boss has an elongate, vertically extending slot 88 and an accessway 90 to the slot. The inner surface of the side wall 80*b* of the end cap 78 is formed with a similar boss 92 having an axially extending cylindrical socket 94 therein. Since the retracting roller 32 is equipped with a conventional spring motor, the driving end of it has a blade projecting axially therefrom and the non-driving end has a cylindrical shaft projecting from it. The shaft may be received in the socket 94 in the boss 72 while the blade may be received in the slot 88 in the boss 86 in respective end caps 78 and 76. In this manner, the retracting roller is mounted as mentioned above for rotary motion and is held so that the spring motor can urge the roller to rotate in a counterclockwise direction as seen in FIG. 2. As can also be seen in FIG. 2, the bosses are located so that the retracting roller is mounted in the enclosed space 75, formed in the housing underlying the upper wall 74 of the cover 60. Accordingly, when the cover is in the closed position, the roller is so located that a vertically extending plane tangential to the surface of the roller lies closely adjacent the sealing lip 68 of the cover. Therefore, when the support device 38 is moved to its closed position, drawing the sheets with it, the sheet layer 40 of the outermost sheet 26 contacts the sealing lip 68 to establish a seal against air current therebetween.

Each of the end caps 76 and 78 is also formed with a mounting rib 96 projecting inwardly from the inner surface of its side wall 80 and forwardly from the vertically extending portion of its peripheral wall 82. A small concave indentation 98 is formed on the under surface of the rib 96. As shown in FIG. 2, a second spacer comprising a rod 100 spaces the outwardly facing sheet layers 42 and 52 away from the inwardly facing sheet layers 40 and 50 as they are unrolled from the retracting roller 32. Ends of the rod are confined beneath the ribs 96 and are located under the indentations 98. Thus, the outermost outwardly facing sheet layer 42 is confined to lie closely adjacent the sealing lip 70 defined at the upper edge of the rear wall 56 of the main housing structure 28. Again, an effective seal against air current is established between the lip 70 and the sheet layer 42.

The rod 100 is provided with a bearing 101 that comprises a seamless, flexible sleeve 102 which may be extruded of an antifriction material such as polyethylene of from 1 to 6 mils thickness. This sleeve 102 has a larger radius than does the rod 100 so that the sleeve may be loosely received about the rod. When the sheet layers 52 and 42 are moved between open and closed positions, the sleeve is caused to rotate about the rod at the same linear speed as the sheet layer 52 that is in contact with it. Accordingly, abrasion between the rod and sheet layer is essentially eliminated.

Referring again to FIGS. 3 and 7, the frame further includes side channels, generally indicated at 102, that may be continuously extruded from a plastic material. Each side channel is mounted along one vertical edge of the window 12, for example, as by being attached to the side of the molding 22 as shown in FIG. 1. The entire frame structure may be recessed or partially recessed, however. Further each side channel comprises a base wall 104 and two sealing walls 106 and 108 projecting in mutually parallel relation from the vertical edges of the base wall 104. Each sealing wall 106 and 108 is formed with an inwardly projecting internal rib 110 and 112 respectively, one of which is coplanar with the other. Accordingly, a slideway 114 is defined between the ribs 110 and 112 and the base wall 104. The tab 84 formed on each end cap 76 and 78 may be inserted into one slideway to assemble one end cap and one side channel together. Further, as shown in FIGS. 2 and 7, with the cover of the main housing structure in its closed position, a screw 116 may be tapped through the sealing lip 68 into the sealing wall 106 of the side channels 102. In this way, the cover 60 is held in its closed position and the main housing structure 28, one end cap 76 or 78, and one side channel 102 are assembled together.

The side channels may also easily be cut to the appropriate length for installation on windows of different sizes using a hack saw or similar tool.

The frame 30 is completed by a head channel 118, which is also made of an extruded plastic material. The head channel includes a head wall 120 and two mutually parallel facing walls 122 and 124 depending from laterally extending edges of the head wall. One inwardly projecting rib 126 and 128 is formed on the inner surface of each facing wall 122 and 124. These ribs are in coplanar relation and a head space 130 is defined between them and the head wall 120.

The depending facing walls 122 and 124 of the head channel are spaced by a distance slightly larger than that between the sealing wall 106 and 108 of the side channels 102. Accordingly, the head channel may be mounted on the side channels by receiving end portions of the side channels until the upper edge thereof abutts the internal ribs 126 and 128. (See FIG. 2). Again, the extruded head channel may be cut to appropriate size conveniently using a tool such as a hack saw.

It will be appreciated then that in the preferred embodiment each of the extruded plastic frame members, which constitute the frame of the movable insulation apparatus, is an inexpensive extruded structure that may be easily sized for installation in building openings having various dimensions.

Referring again to FIG. 2, the apparatus of the present invention further includes an arrangement in the support device 38 that in cooperation with the spacer rod 100, spaces the sheet layers 50 and 52, and 40 and 42 apart in the region between the head and the foot of the opening when the sheets are in their closed position. More particularly, the support device 38 comprises a cylindrical support bar 134. The innermost sheet 44 is passed around the support bar, which thereby supports the sheet intermediate its ends 46 and 48 that are attached to the retracting roller 32. The sheet layers 50 and 52 of this innermost sheet 44 are urged toward one another by a tubular member 136 mounted in concentric relation about the support bar 134. This tubular member has a downwardly open slot 138 through which the sheet 44 passes both before and after being wrapped around the support bar 134. Accordingly, in the region of the support bar, the sheet layers 50 and 52 are spaced by a distance at most equal to the width of the slot 138.

Figure 15:
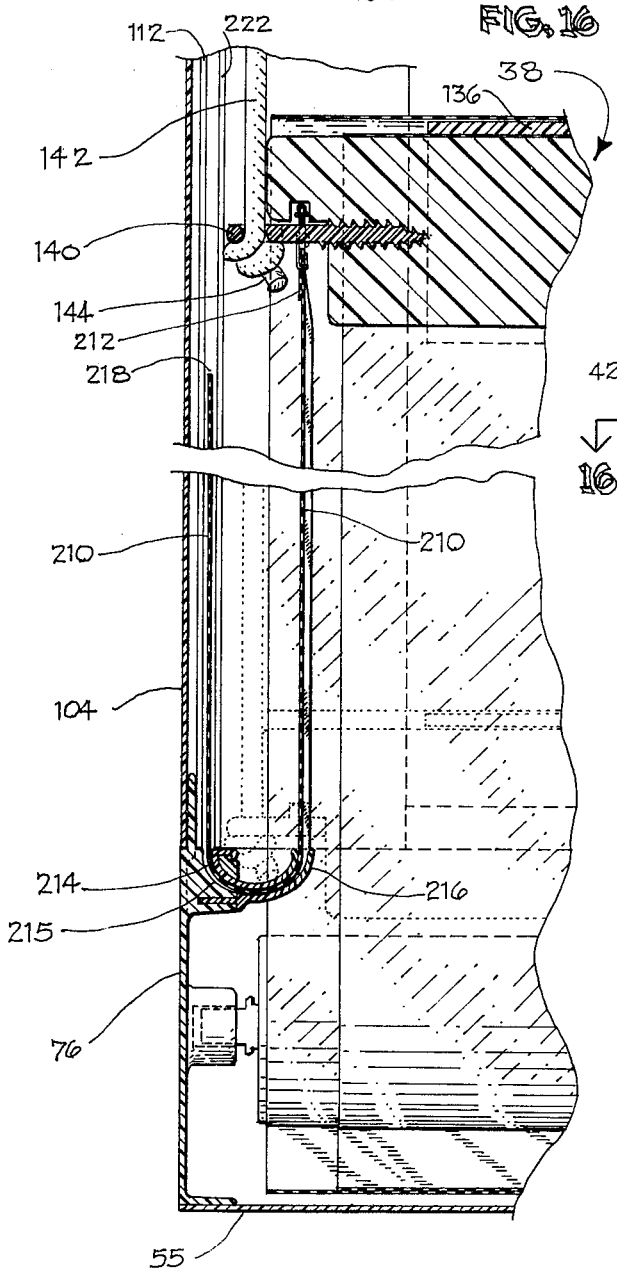
FIG. 15 is a vertical cross-sectional view taken on plane 15—15 in FIG. 14 looking rightwardly.

The outer sheet 26 passes around the outer surface of the tubular member 136 and the sheet layers 40 and 42 constituted thereby are accordingly spaced apart by the diameter of this tubular member. Further, as can be seen in FIG. 2, the diameter of the tubular member 136 is the same as, or only slightly larger than the distance between the facing walls 122 and 124 of the head channel 118. Therefore, an effective seal between the outermost sheet layers 40 and 42 and the facing walls may be established when the support structure is in its closed position C shown in FIG. 2. The tubular member is nevertheless cut to a length shorter than the distance between the side walls of the side channels as shown in FIG. 15.

The tubular member 136 has a diameter larger than the support bar 134. Further, the member 136 has a natural resilience being preferrably made of paper or extruded plastic. Therefore, it tends to urge the outer sheet layers 40 and 42 away from the axis of the support bar. The edges of the layers are in turn urged into tight engagement with the side walls of the side channels to make an effective seal therewith. However, because of the construction of the shortened tubular member 136, excessive friction between edges of these sheet layers and the side walls of the side channels is avoided.

The movable insulation apparatus shown in FIG. 2 may, of course, by modified by addition of more sheets to constitute further sheet layers. Spacer devices may be provided in conjunction with the supporting device 38 comprising additional concentrically mounted tubular members, each like that indicated at 136.

The number of such concentric tubular members should be equal to the number of sheets less one. The slots in all such tubular members are registered, that is, face downwardly. The innermost sheet corresponding to 44 in FIG. 2 passes through the slot in the tubular member having smallest diametric dimension and over the support bar 134. Each successively positioned sheet passes through one slot in one of the tubular members, and over the outer surface of the adjacent member having smaller diametric dimension. The outermost sheet passes over the outer surface of the outermost tubular member.

Accordingly, the spacer devices described above mount the sheet layers with dead air spaces between adjacent layers to improve the insulation value of the movable insulation apparatus when in the closed position.

The movable insulation apparatus further includes a mechanism for moving the support structure 38 between its open and closed positions to move the sheet layers similarly between open and closed positions. More particularly, one eyelet having a shank is threaded into each axially opposed end of the support bar 134 (see FIGS. 2 and 15). A draw cable in the form of a cord 142 has opposing ends 144 each of which is passed through one eyelet 140 and is knotted beneath the eyelet. Accordingly, simultaneous movement of each cord end draws both ends of the support bar 134 upwardly or permits it to move downwardly, under the influence of tension on the sheet layers caused by the motorized retracting roller. Further, the arrangment of the cord end in the eyelets permits the support bar 134 and the tubular member 130 to pivot about the axis of the support bar 134 and thereby accommodate slight rotary movement of the sheets thereon. This pivoting movement of the support structure 38 as a whole is necessary because of the different rates at which the sheets are rolled off of or back onto the retracting roller due to the different radii of one sheet layered against another.

Figure 8:
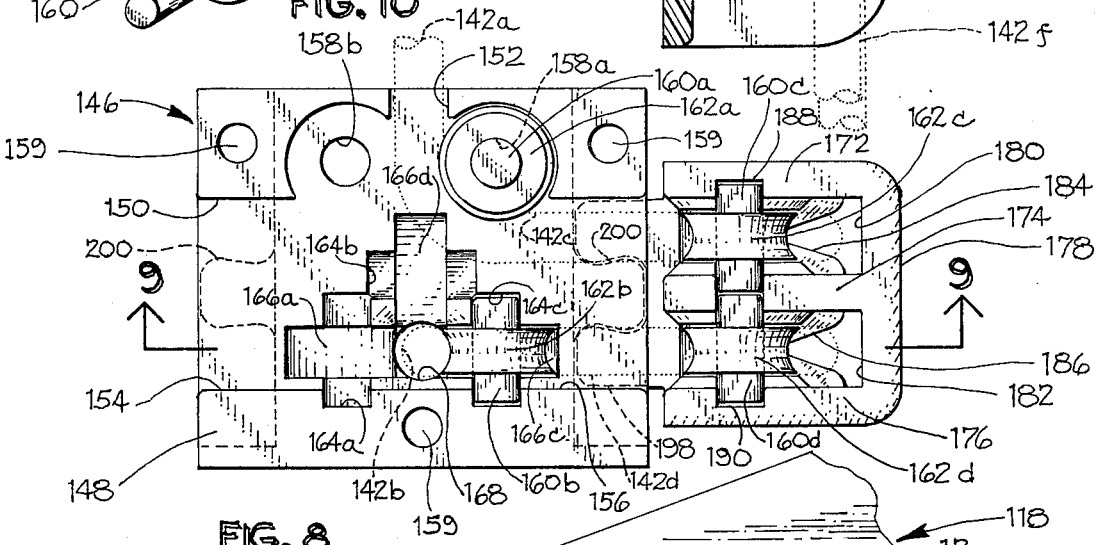
FIG. 8 is a top plan view of a universal pulley block and jam cleat assembly used to move the support bar and sheet layers between their opened and closed positions.
Figure 11:
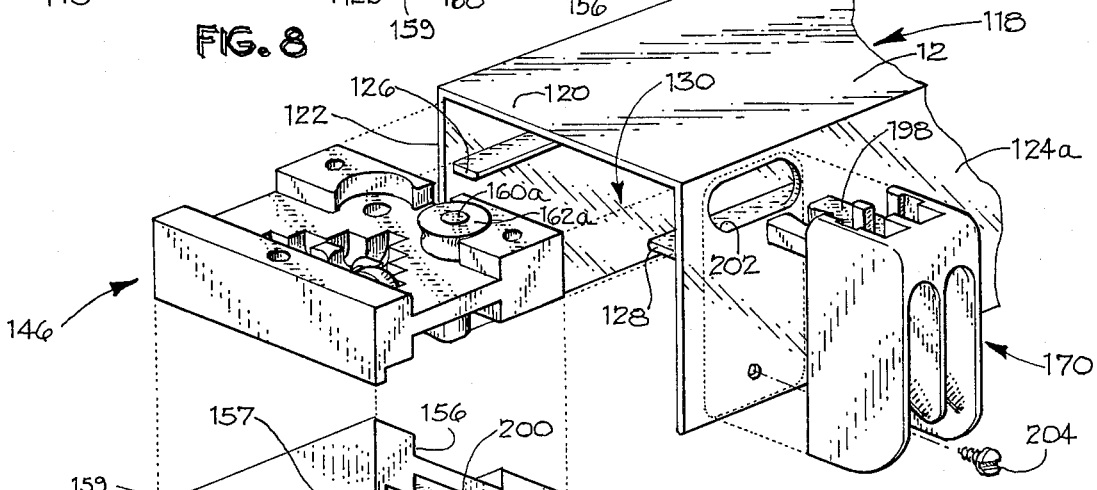
FIG. 11 is a perspective view of the jam cleat and pulley block as well as of a head channel of the frame showing how the three components are assembled.

The movable insulation apparatus of the invention further includes an assembly for guiding the cord from the support device 38 to the head channel 118 through the head space 130 and out to one side or front of the frame so that it may be manipulated by an operator. This assembly is designed for economical construction and simple installation and is shown in detail in FIGS. 8 through 12. As can be seen there, the assembly includes a "universal" pulley block generally indicated at 146. The block is called "universal" because it is designed to be installed at either end of the head channel to guide a cord length received from one end of the support device along any one of several paths. This "universal" pulley block includes a pulley housing 148, the upper surface of which is formed with a generally T-shaped recess 150, having one leg defining a channel 152 and two arms 154 and 156 extending perpendicularly to the channel 152. A vertically extending cylindrical shaft socket **158*a* and 158*b* is formed in the pulley housing 148 on each lateral side of the channel 152. Each shaft socket is adapted to mount a universal shaft 160 and pulley 162 shown in FIG. 10. That is, as can be seen in FIGS. 8 and 11, one shaft 160*a* is mounted in one pulley socket 158*a* on the side of the pulley block to which a cord length 142*a* received through the channel 152 is to be directed. A pulley 162*a* is mounted on a shaft 160*a* in the socket 158*a* to direct the cord length received through the leg 152 rightwardly to the arm 156 of the pulley housing. It will be appreciated that if it is necessary to direct the cord length 142*a* leftwardly through the arm 154, the shaft 160*a* and pulley and 162*a* need only be mounted in the socket 158*b***.

The upper surface of the recess 150 in the pulley block housing is also formed with three horizontally extending shaft sockets **164*a*, 164*b* and 164*c*. Each shaft socket spans a partially cylindrical recess 166*a*, 166*b* and 166*c*. An aperture 168, which extends vertically through the pulley block housing 148, is located at the intersection of the cylindrical recesses. Accordingly, a cord length 142*b* may be received through the aperture and directed by a pulley and shaft assembly, e.g. 160*b* and 162*b*, mounted in socket and cylinder 164*c* and 166*c* through the arm 156 and shown in FIG. 8. Alternatively the cord can be directed through the arm 154 or the channel 152 depending upon which socket and cylinder 164 and 166** in which a pulley and shaft are mounted.

Figure 12:
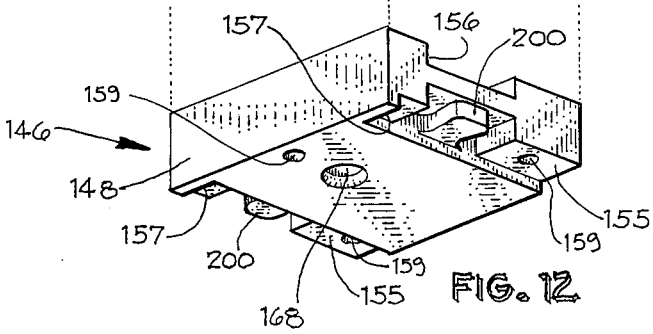
FIG. 12 is a perspective view of the pulley block looking upwardly from the bottom showing various of its structural details.

Each pulley block, when assembled as shown in FIG. 8, may be mounted in the head space and supported by the ribs 126 and 128 in the head channel 118. As can be seen in FIGS. 11 and 12, the ribs 126 and 128 may be cut to be recessed from an end of the head channel. The lower surface of the pulley block housing 148 is formed with opposed rabbets 155 that end in a barrier wall 157, each of which abutts one end of one rib 126 and 128 to prevent the housing 148 from sliding inwardly from the ends of the head channel. The pulley block housing is also provided with screw holes 159 to receive screws if the pulley block is to be secured to, for example, a wooden frame.

Accordingly, it will be appreciated that the universal pulley block 146 may be adapted to receive a cord length extending vertically upwardly from one end of the support device through the aperture 168 and then may be either directed outwardly from the pulley block through one of the arms 154 or 156 or to an opposite pulley block through the channel 152. Similarly, the length of the cord received from the other pulley block 142 may be directed outwardly of the housing through an arm 154 or 156 by a pulley 162 and shaft 160 such as shown in FIG. 8. Accordingly, the cords received and guided from both ends of the support device may be directed out of the head channel at a common location and to either side of the frame.

Figure 9:
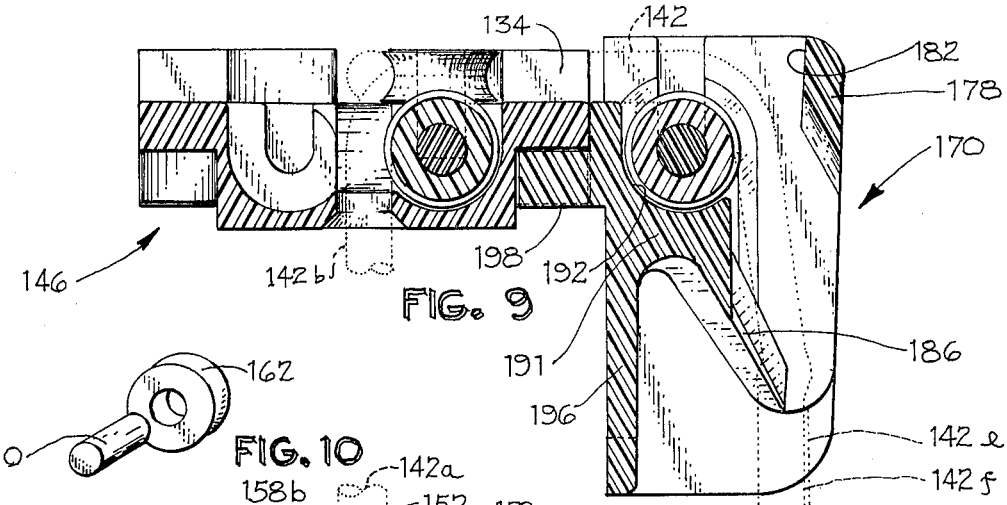
FIG. 9 is a vertical cross-sectional view of this pulley block and jam cleat taken on plane 9—9 in FIG. 8 looking upwardly.
Figure 10:
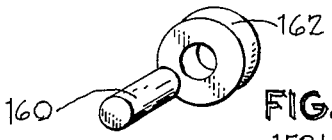
FIG. 10 is a perspective view of a universal shaft and pulley used in both the pulley block and jam cleat shown in FIGS. 8 and 9.

As shown in FIGS. 8, 9 and 11, the arrangements for moving the support device between its open and closed positions further includes a jam cleat generally indicated at 170 comprising three inwardly directed parallel walls 172, 174 and 176 joined at their outer face by an upper facing rail 178. These walls define two passageways 180 and 182, each having a restricted portion 184 and 186 respectively. A shaft socket 188 and 190 spans each of the passageways 180 and 182 respectively, and each is adapted to receive one universal shaft 160*c* or 160*d*. Further, connecting portion 191 between the walls 172, 174 and 176 is formed with two partially cylindrical recesses 192 each of which accommodates one pulley 162*c* and 162*d* carried on each respective shaft. Accordingly, as can be seen in FIG. 9, cord lengths 142*c* and 142 directed through the arm 156 of the recess in the pulley block housing 148 are received by respective pulleys 162*c* and 162*d* in the jam cleat and thereafter directed downwardly through the respective passageways 180 and 182 to form depending cord lengths 142*e* and 142*f*. Therefore, the cords may simultaneously be pulled through the jam cleat to raise the support device 38 or allowed to be drawn back through the jam cleat to lower the device 38.

The cords may be trapped in the restricted portions 184 and 186 of the passageways to prevent the support device from moving toward its open position under the urging of the motor in the retracting roller. As can be seen in FIG. 9, a substantial distance is provided between the outwardly facing rail 178 and restricted portions 184 and 186 in the passageways 180 and 182.

Accordingly, the cords may be pulled outwardly from the jam cleat into the open space formed between the restricted portions and rail to be released from the restricted portions 184 and 186 and, thereafter, permit the support device 38 to move downwardly under the influence of the spring motor in the retracting roller.

As can be seen in FIGS. 1 and 2, the cord lengths 142*e* and 142*f* depending from the jam cleat are passed through a tying buckle 194 that insures that they move simultaneously.

On its rear wall 196, the jam cleat is formed with a sidewardly projecting dove-tail-like clip 198. At each of its laterally opposing sides, on its under surface, the pulley block housing 148 is formed with a complementary dove-tail-like tongue 200. The tongue is shaped and dimensioned to graspingly engage the clip to locate the jam cleat with respect to the pulley block housing. As can be seen in FIG. 11, in order to mount the jam cleat with the pulley block housing in the head space, an elongate hole 202 is first drilled in the forward or inwardly situated facing wall 124*a* through which the clip 198 may pass into engagement with an associated tongue 200. Further, the cords may pass outwardly through this hole to be engaged in the jam cleat. A screw may be provided at the base of the jam cleat and tapped into the inwardly situated facing wall 124*a* to further secure the jam cleat at its mounted position.

The jam cleat can be fabricated without the clip and with additional holes to receive screws if the cleat is to be secured to, for example, a wooden frame.

Accordingly, the "universal" construction of the pulley block mechanism and jam cleat provide maximum flexibility for assembling and installing the apparatus of the invention. The cleat can be mounted on either side of the head channel and the pulley blocks can be assembled to direct cord lengths received vertically from either side of the support device laterally out of the head channel or laterally toward another pulley block and then laterally out of the head channel. When assembled, the universal shafts 160 and pulleys 162 need only be positioned in the appropriate sockets and recesses to provide the desired direction in which each cord length is directed.

It is desirable that at least one of the sheets of the multilayer movable insulation apparatus of the invention be provided with a low emittance surface facing on a dead air space. Emittance is defined as the ratio of the total radiant flux emitted by a surface to that emitted by a surface to that emitted by an ideal black body at the same temperature. In the preferred embodiment, both sides of each of the internal sheet layers 50 and 42 comprising sheet 44 has a low emittance surface and may, for example, by copper, nickel, aluminum, silver or gold foils or foils of alloys of these metals. Material sold under the trademark "Mylar" by E. I. DuPont DeNemours & Co., when provided with an aluminized coating, is also suitable for use as the sheet layers in the movable insulation of the invention. Additionally, material constructed in accordance with U.S. Pat. No. 4,247,599 (Hopper) is very effective in this application and the disclosure of that patent is incorporated herein by reference.

It has been found that each low emittance surface should have a surface emittance sufficiently low to yield a total effective emissivity of the surface and its associated dead air space of no greater than 0.60. Effective emmisivity is defined as the combined effect of the boundary surface emittance and dead air space. Therefore, the maximum acceptable surface emittance of a single surface facing on a single dead air space is 0.60. In the preferred embodiment of the invention, each low emittance surface has a surface emittance sufficiently low to yield a total effective emissivity of the surface and associated dead air space of no greater than 0.06. Thus, the maximum preferred surface emittance of a single surface facing on a single dead air space is 0.06.

The acceptable surface emittance value noted above can be obtained with any of the materials mentioned above. Further, the acceptable and preferred surface emittance and total emissivity values described above should be achieved in the infrared range of the energy spectrum and in the temperature range of 30° F. and 130° F.

Accordingly, in light of the description provided above, the term "low surface emittance" is defined as a surface emittance of no greater than 0.60.

Figure 13:
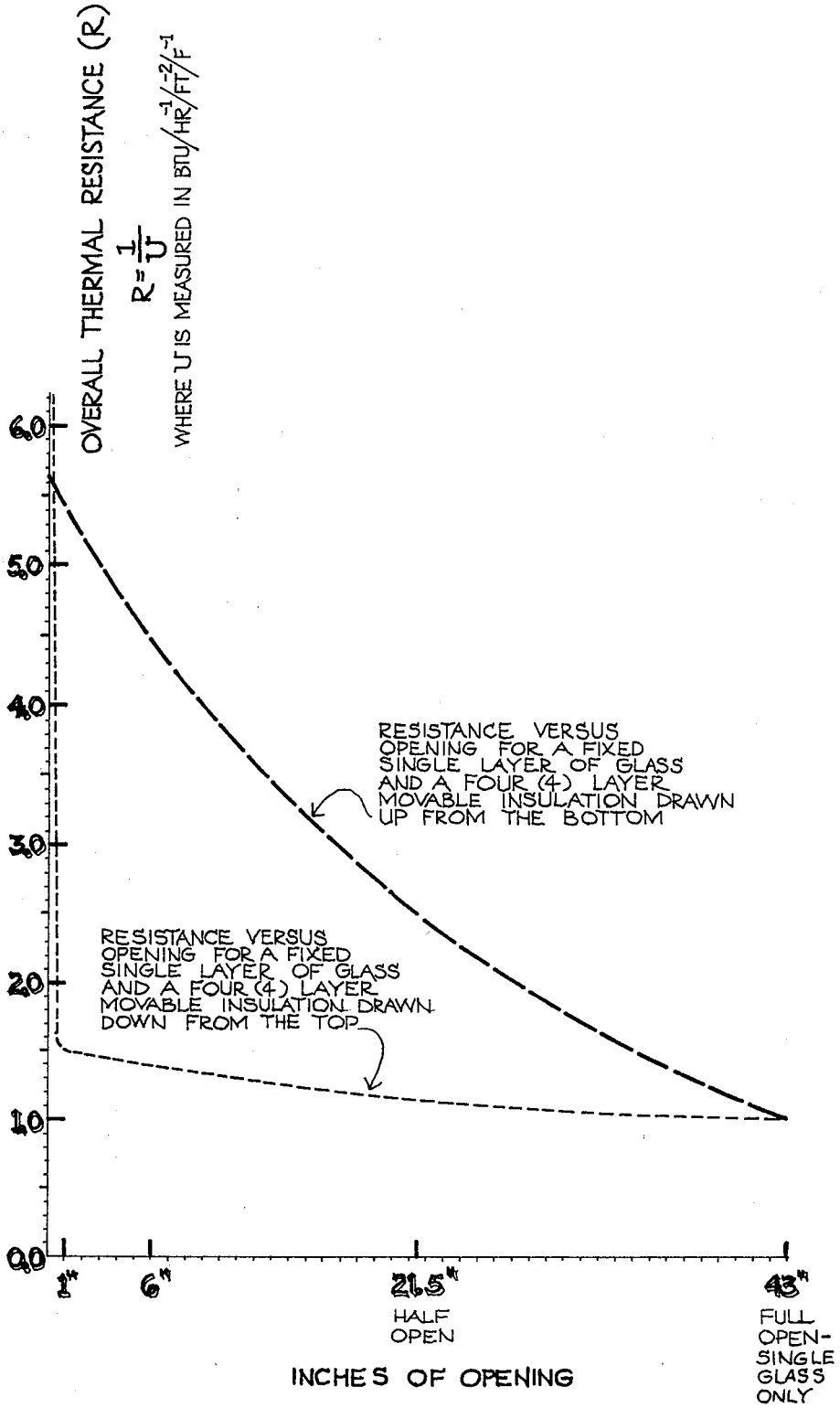
FIG. 13 is a graph of thermal resistance versus the distance, in inches, that movable insulation apparatus is opened comparing resistance provided by the apparatus of the present invention with apparatus such as that shown in the prior Hopper patents drawn from the top of a building opening downwardly.

The unique construction of the movable insulation apparatus of the present invention provides unexpected and surprising results in offering effective insulation against heat transmission. More particularly, it has been found that insulation constructed in accordance with the present invention, movable from an open position at the foot of a building opening such as a window to a closed position at the top of such an opening, that is movable from the bottom to the top of the opening, provides substantially improved insulation particularly when the movable insulation is only partially closed. FIG. 13 is a graph that illustrates this surprising result by comparing nearly identical movable insulation drawn from the top down and from the bottom up over a window having 43 inch height. Inches of insulation opening are plotted along the ordinate and thermal resistance (R) is plotted along the abscissa. Thermal resistance R is defined as the reciprocal of thermal conductance U, i.e. $R=1/U$. U is measured in $BTU/HR^{-1}/FT^{-2}/F.^{-1}$. The thermal resistance per inches of opening for a four layer movable insulation constructed in accordance with the preferred embodiment of the present invention and drawn from the foot of the opening to the head (the "bottom-up" insulation) is shown by the bold face, coarsely dotted line. A similar function for a similar movable insulation drawn from the head to the foot of the opening (the "top-down" insulation) is shown by the light face, finely dotted line.

As can be seen, when fully closed, the "top-down" construction provides very high thermal resistance in excess of 6.0. However, when such insulation is opened from the bottom up by as little as less than one of 43 total inches, substantial thermal resistance is lost. That is, between fully closed and one inch opened positions, the overall thermal resistance of a "top-down" insulation device drops from more than 6.0 to approximately 1.5. When such insulating apparatus is moved from the one inch open position to the fully opened position, overall thermal resistance drops only from about 1.5 to about 1.2. Therefore, it can be seen that to be effectively operated, such insulating apparatus must be carefully and fully closed. Further, it if is desired to open such "top-down" insulating apparatus sufficiently, that is by more than a negligible amount to allow light to pass through the building opening, a large portion of the thermal resistance provided by the device is lost.

In contradistinction, the "bottom-up" movable insulation apparatus of the present invention provides substantial thermal resistance even when opened substantially. For example, when fully closed, the insulating apparatus of the present invention provides an overall thermal resistance of about 5.6. When half opened, to 21.5 inches this insulating apparatus still provides an overall thermal resistance of about 2.5. Thus, at the half-opened position, the movable insulation apparatus of the present invention provides nearly twice the overall thermal resistance as that provided by "top-down" insulation.

It is believed that this substantial and surprising improvement in overall thermal resistance provided by the apparatus of the invention when partially opened, over known "top-down" insulation when also partially opened, results for the following reasons. Heavy cold air that lies between the insulation and, for example, a window tends to spill or leak into a room from under a "top-down" apparatus when partially opened. However, an effective seal between the apparatus of the invention and the frame, at the foot, of the opening is formed even when the apparatus is not fully closed. Therefore, heavy cold air cannot leak from under the apparatus.

The apparatus of the invention also maximizes conventional usefulness of a building opening without sacrificing insulating value because of its "bottom-up" mode of operation. For example in summer, when the sun is high in the sky, the apparatus can be opened a substantial amount to admit light without admitting direct sunlight that tends to heat the interior of the building. This is because even with small building overhangs the upper portion of a window is shaded or shielded more than the lower portion. Conversely, with conventional top-down insulation direct sunlight often must be admitted through the bottom of a window even if the insulation is only partially opened. This of course increases unwanted solar gain.

Aesthetically, the apparatus of the invention is also beneficial. Since people tend to look out of the middle or upper portions of a window, its operation is appropriate. Further, more useful natural lighting may be admitted through the top rather than the bottom of the window, and this light penetrates more deeply into a room to provide greater brightness.

It is believed that the substantial improvement in insulating value provided by the present invention has not previously been known in the prior art. It is further submitted that an effective "bottom-up" construction such as that provided by the present invention has heretofore not been devised.

Figure 16:
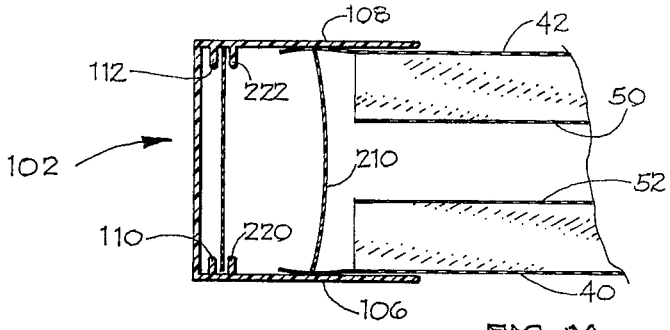
FIG. 16 is a horizontal cross-sectional view taken on plane 16—16 in FIG. 14 looking downwardly.
Figure 14:
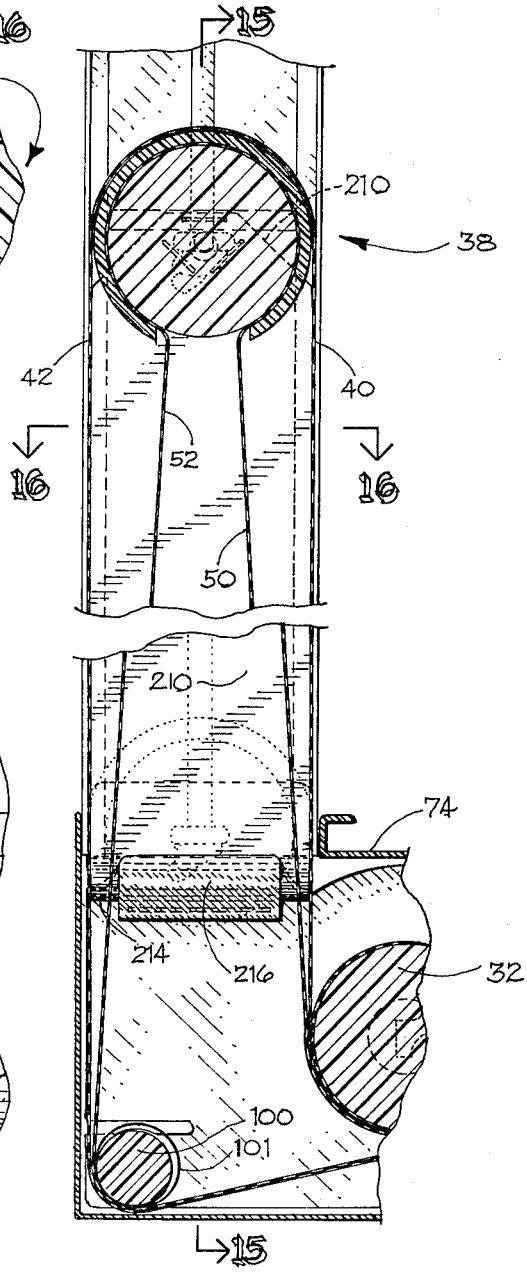
FIG. 14 is a vertical cross-sectional view similar to that shown in FIG. 2 of movable insulation apparatus in accordance with the present invention incorporating a side sealing panel.

The present invention may also include structure for sealing the outermost sheet layers 40 and 42 tightly against the sealing walls 106 and 108 of the side channels 102. As can be seen in FIGS. 14 through 16, a preferred side sealing arrangement is compact and comprises a sealing panel, having one end 212 secured to one eyelet 140 at one end of the support bar. The panel is an elongated strip having a width approximately equal to or only slightly less than the distance between the sealing walls 106 and 108 of the side channels. The panel is made of a normally flat, elongated, relatively stiff, resilient yet flexible sheet-like material such as "Mylar". As can be seen in FIG. 15, the panel 210 urges the outermost sheet layers 40 and 42 outwardly into sealing engagement with the sealing walls 106 and 108. Since these outermost sheets have thickness, the panel will be bowed slightly as shown in FIG. 16 when confined therebetween. Further, as shown in FIG. 16 the innermost sheet layers 50 and 42 should have width slightly smaller than the width of the layers 40 and 42 to accommodate the panel when the apparatus is drawn to its closed position.

As shown in FIGS. 14 through 16, the movable insulation apparatus also includes a structure for storing the panel 210 when the sheets and support device are retracted to their open position. More particularly, a generally U-shaped guideway 214 is mounted at the upper end of each end cap 76 and 78 and is formed with a generally U-shaped slot 215 therethrough. The free end 218 of the panel 210 is fed through the mouth 216 of slot 215 and thereby directed outwardly from the sheet layers and thereafter upwardly toward the head of the apparatus. Second projecting ribs 220 and 222, which together are in coplanar relation, are formed on each of the sealing walls 106 and 108, and extend in parallel relation to the internal ribs 110 and 112. Accordingly, a guide space is provided for the free end 218 of the panel within each side channel adjacent the side channel base wall 104. Since the panel 210 is stiff yet flexible so that it can urge the sheet layers 40 and 42 outwardly into sealing engagement with the sealing walls 106 and 108 as shown in FIG. 16, its free end will also be tracked through the slot 215 in the guideway 214 and upwardly through the guide space provided by the internal ribs 110,220,112 and 222. Conversely, when the support device is moved to its open position, the panel will be drawn through the guideway and positioned between the outer sheet layers 40 and 42 as shown in FIG. 16.

Accordingly, it will be appreciated that the apparatus of the present invention effectively seals against air flow around its peripheral edges at the side channels, head channels and housing. Therefore, the insulating value provided by it is substantially enhanced.

Although specific embodiments of the present invention have been described above in detail, this is only for purposes of illustration. Modifications may be made to the described movable insulation apparatus in order to adapt it to particular applications.

What is claimed is:

1. Movable insulation apparatus for selectably covering and uncovering an opening, such as a window, door or the like, in a wall of a building to control the amounts of heat energy and light transmitted through said opening, said opening having a foot, a head situated above said foot, and height and width; said movable insulation apparatus comprising:

sheet means having a leading end and a trailing end, width at least equal to the width of said opening and length at least equal to twice the height of said opening;

a retracting roller rotatably mounted and spanning the width of said opening at said foot, said trailing end of said sheet means being attached to said roller and said leading end of such sheet being secured in the region of said foot;

motor means for urging said roller in one angular direction to retract said sheet means thereon;

means for supporting said sheet intermediate its ends, spanning the width of said opening and mounted for reciprocal movement between an open position in the region of said foot and a closed position in the region of said head of said opening, said sheet means passing around said support means to define two sheet layers extending between the region of said foot and said support means, said support means further being mounted for pivoted movement about the horizontal axis thereof to prevent abrasion of said sheet means thereon.

2. Movable insulation apparatus according to claim 1 further comprising means accessible from one side of said opening for moving said support means between its open position and its closed position.

3. Movable insulation apparatus according to claim 2, said moving means comprising cable means having an end attached to said supporting means, and pulley means mounted in the region of said head of said opening for guiding said cable means from said supporting means to said head and then to said one side of said opening.

4. Movable insulation apparatus according to claim 3, wherein said cable means comprises first and second cable lengths each attached to respective first and second ends of said supporting means, and wherein said pulley means comprises first and second universal pulley blocks each mounted in the region of said head of said opening respectively above said first and second ends of said supporting means, each said pulley block being formed to receive a cable length from said supporting means and selectably guide it directly toward said one side of said opening, toward the side of said opening opposite said one side, and toward the other said pulley block; each said pulley block further being formed to receive a cable length from the other said pulley block and selectably guide it toward said one side of said opening and toward said side of said opening opposite said one side.

5. Movable insulation apparatus according to claim 4, wherein each said pulley block comprises a housing formed with an aperture therethrough for receiving a cable length from one said end of said supporting means, and a first pulley; said housing further being formed with first pulley-positioning socket means for selectably mounting said first pulley in position to guide a cable length received through said aperture toward said one side of said opening, toward said side of said opening opposite said one side, and toward said other pulley block.

6. Movable insulation apparatus according to claim 5, each said pulley block further comprising a second pulley; said housing further being formed with a channel for receiving a cable length from the other said pulley block and second pulley-positioning socket means for selectably mounted said second pulley in position to guide a cable length received through said channel toward said one side of each opening and toward said side of said opening opposite said one side.

7. Movable insulation apparatus according to claim 3, further comprising means for releasably securing said cable means in a set position to secure said supporting means in a corresponding set position from said opened position to said closed position.

8. Movable insulation apparatus according to claim 7, said pulley means comprising a pulley block housing, said pulley block housing and said securing means being formed with interengaging dove-tail means for linking the two together.

9. Movable insulation apparatus according to claim 1, further comprising a plurality of said sheet means one overlying another, all having length at least equal to twice the height of said opening, a trailing end secured to said roller, and a leading end secured in the region of said foot; and all passing around said support means, each said sheet thereby defining two sheet layers extending between the region of said foot and said support means, and said plurality of sheets thereby defining twice said plurality of said sheet layers.

10. Movable insulation apparatus according to claim 9, further including spacer means for spacing adjacent sheet layers apart to define a dead air space therebetween and comprising a number, equal to said plurality of sheet means less one, of concentric tubular members mounted in concentric relation about said supporting means, each having an axially extending slot therein, the slot in each member being wider than the slot in the adjacent member having smaller diametric dimension, said slots being registered with each other and all opening toward said foot; and wherein one said sheet means passes through the slot in said member having smallest diametric dimension and about said supporting means with said sheet layers defined thereby spaced apart in the region of said supporting means by a distance at most equal to the width of said slot in said member having smallest diametric dimension; and a number of said remaining layers, each passing through one said slot in one of said remaining members and about the adjacent member having smaller diametric dimension, with said sheet layers defined thereby spaced in the region of said support means by a distance at most equal to the width of said one slot.

11. Movable insulation apparatus according to claim 10, wherein the outermost of said sheet means passes over the tubular member having largest diametric dimension with said sheet layers defined thereby spaced in the region of said supporting means by a distance equal to said largest diametric dimension.

12. Movable insulation apparatus according to claim 1, wherein said leading end of said sheet means is also attached to said retracting roller, whereby said sheet layers defined thereby are retracted simultaneously onto said roller, said apparatus further comprising means for spacing said sheet layers apart, as they extend between said support means and said foot, to provide a dead air space therebetween, said spacing means comprising an idler element extending generally parallel to and spaced laterally from said roller about which at least one of said sheet layers passes.

13. Movable insulation apparatus according to claim 12, further comprising bearing means for preventing abrasion of said one sheet layer on said idler element.

14. Movable insulation apparatus according to claim 13, said bearing means comprising a flexible, smooth-surfaced tubular sleeve loosely received about said idler element to freely rotate thereabout, the outer surface of said sleeve being moved by said one sheet layer at the same linear speed thereas to prevent abrasion of said one sheet layer on said element.

15. Movable insulation apparatus according to claim 1, further comprising means for minimizing passage of air to and from said opening about the peripheral edges of said sheet means.

16. Movable insulation apparatus according to claim 15, said air passage minimizing means comprising frame means including a pair of side sealing channels each mounted along a generally vertically extending edge of said opening and each comprising a rear wall and two spaced sealing walls projecting therefrom between which said sheet layers are confined and against each of which an edge portion of one of said sheet layers lies.

17. Movable insulating apparatus according to claim 16, further comprising means for urging said edge portion of each said one sheet layer against the associated sealing wall of one said side sealing channel.

18. Movable insulating apparatus according to claim 17, said urging means comprising a normally flat, flexible, resilient, elongated sheet-like panel extending tranversely between said sealing walls of said side channel to urge each of two confronting edge portions of two of said sheet layers against an associated sealing wall; said side panel having width approximately equal to the distance between said sealing walls of said side sealing channel.

19. Movable insulation apparatus according to claim 18, further comprising means for storing said panel when said supporting means is not in said closed position.

20. Movable insulation apparatus according to claim 19, said panel having first and second ends and between said ends length longer than the distance from said head to said foot of said opening, said first end being attached to said supporting means to be moved therewith between said open and closed positions, said storing means comprising a guide member, formed with a U-shaped guideway, mounted in the region of said foot of said opening for directing said panel outwardly from said edge portions of said sheet layers and upwardly toward said head, and guide channel means formed in said sealing channel for guiding said second end of said panel from said guideway toward said head, said panel thereby being guided into said guide channel when said supporting means is moved to said closed position.

21. Movable insulation apparatus according to claim 17, said air passage minimizing means comprising a head channel mounted along the horizontal edge of said opening at said head and including a head wall and two spaced facing walls depending therefrom, said supporting means with said sheet means passing therearound being at least partially receivable in said head channel with each facing wall lying against one said sheet layer.

22. Movable insulation apparatus according to claim 21, further comprising means for urging each said sheet layer against one said facing wall.

23. Movable insulation apparatus according to claim 22, said last-recited urging means comprising a resilient tubular member, having a slot therein, received in concentric relation about said supporting means and having a normal inside diameter larger than the outside diametric dimension of said supporting means and an outside diameter at least equal to the distance between said facing walls, whereby said tubular member resiliently urges each said sheet layer into contact with one facing wall.

24. Movable insulation apparatus according to claim 1, further comprising housing means for mounting and enclosing said retracting roller and portions of said sheet means retracted thereon; said housing means being mounted at said foot of said opening.

25. Movable insulation apparatus according to claim 24, said housing means comprising a pair of mutually parallel, horizontally extending sealing lips between which is defined an upwardly open slot through which said sheet layers pass, said housing means being constructed to mount said roller therein with one of said sheet layers extending tangentially therefrom into contact with one of said lips and thereafter to said supporting means when said supporting means is in its closed position.

26. Movable insulation apparatus according to claim 24, said housing means comprising a rear wall having an upper horizontally extending edge defining one sealing lip, a bottom wall, and a closure member pivotably mounted with said bottom wall for movement between a closed position, forming with said rear and bottom walls an enclosed space, and an open position providing access to said enclosed space, said closure member having a horizontally extending edge defining a second sealing lip which when said closure member in said closed position is spaced from said one lip to define an upwardly open slot through which said sheet layers pass; said housing means further comprising a pair of end caps mounted at opposing ends of said rear and bottom walls and said closure member and comprising means for mounting said roller in said enclosed space with a generally vertically extending tangential plane therefrom lying adjacent said second lip when said closure member is in said closed position to position one said sheet layer in contact with said second lip when said supporting means is in its closed position.

27. Movable insulation apparatus according to claim 26, wherein said leading end of said sheet means is also attached to said retracting roller whereby said sheet layers defined thereby are retracted simultaneously onto said roller, said apparatus further comprising means for spacing said sheet layers apart, as they extend between said supporting means and said roller, to provide a dead air space therebetween, said spacing means comprising an idler element, said end caps further comprising means for mounting said element in said enclosed space to extend in generally parallel relation to and spaced laterally from said roller with a generally vertical tangential plane therefrom lying adjacent said one lip, at least one other of said sheet layers passing around said element and extending therefrom to said support means in contact with said one lip.

28. Movable insulation apparatus according to claim 27, further comprising bearing means for preventing abrasion of said one other sheet layer on said idler element.

29. Movable insulation apparatus according to claim 28, said bearing means comprising a flexible, smooth-surfaced, tubular sleeve loosely received about said idler element to freely rotate thereabout, the outer surface of said sleeve being moved by said one other sheet layer at the same linear speed thereas to prevent abrasion of said one other sheet layer on said element.

30. Movable insulation apparatus for selectably covering and uncovering an opening such as a door, window or the like, in a wall of a building to control the amount of heat energy and light transmitted through said opening, said opening having a foot, a head situated above said foot, and height and width; said movable insulation comprising:

a plurality of sheet means each having a leading end and a trailing end, width at least equal to the width of said opening and length at least twice the height of said opening;

a retracting roller rotatably mounted and spanning the width of said opening at said foot, said leading end and said trailing end of each said sheet means being attached to said roller;

motor means for urging said roller in one angular direction to retract said sheet means thereon;

means for supporting all of said sheet means intermediate their ends, spanning the width of said opening and mounted for reciprocal movement between an open position in the region of said foot and a closed position in the region of said head, each said sheet means passing around said supporting means to define two sheet layers extending between the region of said foot and said supporting means; and means for spacing adjacent ones of said plurality of sheet layers apart to provide a dead air space therebetween, said spacing means comprising a number, equal to said plurality of sheet means less one, of tubular members mounted in concentric relation about said supporting means, each having an axially extending slot therein, the slot in each member being wider than the slot in the adjacent member having smaller diametric dimension, said slots being registered with each other and all opening toward said foot, one said sheet means passing through the slot in said tubular member having smallest diametric dimension and about said supporting means with said sheet layers defined thereby spaced apart in the region of said supporting means by a distance at most equal to the width of the slot in said member having smallest diametric dimension, a number of said remaining sheet means each passing through one said slot in one of said remaining tubular members and about the adjacent member having smaller diametric dimension, with said sheet layers defined thereby spaced in the region of said supporting means by a distance at most equal to the width of said one slot, said spacing means further comprising an idler element extending generally parallel to and spaced laterally from said roller mounted in the region of said foot and about which a portion of said plurality of sheet layers pass.

31. Movable insulation apparatus according to claim 30, further comprising frame means for sealing the periphery of said sheet layers when said supporting means is in the closed position, said frame means comprising an elongate extruded housing mountable at the foot of said opening and including a rear wall, a bottom wall, and a front wall, said rear and front wall defining a laterally extending slot through which said sheet layers pass, said walls further defining opposing open ends; said housing also comprising a pair of end caps each including a side wall, a peripheral guide wall projecting from the periphery of said side wall and shaped to be received in telescoping relationship in one said open end of said walls, and an upstanding tab projecting from said side wall; said frame means further comprising a pair of extruded vertically extending side channels each mounted along one vertical edge of an opening and including a base wall, two sealing walls projecting in mutually parallel relation from said base wall and a pair of internal ribs each projecting inwardly from one sealing wall in generally coplanar relation with the other and generally parallel to said base wall to define a vertically extending slideway therewith, said tab of one end cap received in one slideway in one side channel to mount the two together; said frame means also comprising a head channel mounted at the head of said opening and including a head wall and a pair of facing walls depending from edge portions of said head wall, said sealing walls of each said channel being received between said facing walls of said head channel in the region of the ends thereof to mount the three together.

32. An antifriction bearing device for guiding a sheet-like material along a path comprising:

an elongate idler element mounted transversely across said path, and a flexible, smooth-surfaced, thin-walled, tubular sleeve loosely received about said idler element to freely rotate thereabout, the wall of said sleeve being rotated about said idler element by contact with said sheet-like material at the same linear speed thereas to prevent abrasion of said sheet-like material on said element.

33. An antifriction bearing device according to claim 32 wherein said idler element is cylindrical.

34. An antifriction bearing device according to claim 33 wherein said idler element is a rod.

35. An antifriction bearing device according to claim 32 wherein said sleeve comprises an extruded, seamless polymeric material.

36. An antifriction bearing device according to claim 35 wherein said sleeve comprises polyethylene.

37. Movable insulation apparatus for selectably covering and uncovering an opening such as a door, window or the like, in a wall of a building to control the amounts of heat energy and light transmitted through said opening; said movable insulation comprising:

a plurality of sheet means each having a leading end and a trailing end, width at least equal to the width of said opening and length at least equal to twice the length of said opening;

a retracting roller rotatably mounted and spanning the width of said opening at one extreme edge thereof, said leading end and said trailing end of each said sheet means being attached to said roller;

motor means for urging said roller in one angular direction to retract said sheet means thereon;

means for supporting all of said sheet means intermediate their ends, spanning the width of said opening and mounted for reciprocal movement between an open position in the region of said one extreme edge of said opening and a closed position in the region of the edge of said opening opposite said one edge, each said sheet means passing around said support means to define two sheet layers extending between the region of said one edge of said opening and support means; and means for spacing adjacent ones of said plurality of sheet layers apart to provide a dead air space therebetween, said spacing means comprising a number, equal to said plurality of sheet means less one, of tubular members mounted in concentric relation about said supporting means, each having an axially extending slot therein, the slot in each member being wider than the slot in the adjacent member having smaller diametric dimension, said slots being registered with each other and all opening toward said one edge of said opening, one said sheet means passing through the slot in said tubular member having smallest diametric dimension and about said supporting means with said sheet layers defined thereby spaced apart in the region of said supporting means by a distance at most equal to the width of the slot in said member having smallest diametric dimension, a number of said remaining sheet means each passing through one said slot in one of said remaining tubular members and about the adjacent member having smaller diametric dimension, with said sheet layers defined thereby spaced in the region of said support means by a distance at most equal to the width of said one slot.

38. Movable insulation according to claim 37, said spacing means further comprising an idler element extending generally parallel to and spaced laterally from said roller mounted in the region of said one edge of said opening and over which a portion of said plurality of sheet layers passes.

39. In a movable insulation apparatus for selectably covering and uncovering an opening such as a door, window or the like, in a wall of a building to control the amounts of heat energy and light transmitted through said opening, said opening having a foot and a head situated above said foot; said movable insulation comprising at least one sheet layer; a retracting roller rotatably mounted and spanning the width of said opening at said foot, one end of the sheet layer being attached to said roller; motor means for urging said roller in one angular direction to retract said sheet layer thereon; means for supporting said sheet means intermediate its ends, spanning the width of said opening and mounted for reciprocal movement between an open position in the region of said foot and a closed position in the region of said head; the improvement comprising:

cable means including first and second cable lengths each attached to respective first and second ends of said supporting means; and first and second universal pulley blocks each mounted in the region of said head of said opening respectively above said first and second ends of said supporting means, each said pulley block being formed to receive a cable length from said supporting means and selectably guide it directly toward one side of said opening, toward the side of said opening opposite said one side, and toward the other said pulley block, each said pulley block further being formed to receive a cable length from the other said pulley block and selectably guide it toward said one side of said opening and toward said side of said opening opposite said one side.

40. The improvement in movable insulation apparatus according to claim 39, wherein each said pulley block comprises a housing formed with an aperture therethrough for receiving a cable length from one said end of said supporting means, and a first pulley; said housing further being formed with first pulley-positioning socket means for selectably mounting said first pulley in position to guide a cable length received through said aperture toward said one side of said opening, toward said side of said opening opposite said one side, and toward said other pulley block.

41. The improvement in movable insulation apparatus according to claim 40, each said pulley block further comprising a second pulley; said housing further being formed with a channel for receiving a cable length from the other said pulley block, and second pulley-positioning socket means for selectably mounting said second pulley in position to guide a cable length received through said channel toward said one side of each opening and toward said side of said opening opposite said one side.

42. The improvement in movable insulation apparatus according to claim 39, further comprising means for releasably securing said cable means in a set position to secure said supporting means in a corresponding set position from said opened position to said closed position.

43. The improvement in movable insulation apparatus according to claim 42, said pulley means comprising a pulley block housing, said pulley block housing and said securing means being formed with interengaging dovetail means for linking the two together.

44. In a movable insulation apparatus for selectably covering and uncovering an opening such as a door, window or the like, in a wall of a building to control the amount of heat energy and light transmitted through said opening, said movable insulation comprising at least one sheet layer; a retracting roller rotatably mounted and spanning the width of said opening at one edge thereof, one end of said sheet layer being attached to said roller; motor means for urging said roller in one angular direction to retract said sheet layer thereon; and means for mounting said sheet layer for reciprocal movement between an open position withdrawn from said opening and a closed position covering said opening; the improvement comprising:

housing means for mounting and enclosing said retracting roller and portions of said sheet layer retracted thereon and including a pair of mutually parallel, horizontally extending sealing lips between which is defined an open slot through which said sheet layer passes, said housing means being constructed to mount said roller therein with said sheet layer in its closed position, extending tangentially therefrom into contact with one of said lips.

45. The improvement in movable insulation apparatus according to claim 44, said housing means comprising a rear wall having a horizontally extending edge defining one said sealing lip, a bottom wall, and a closure member pivotably mounted with said bottom wall for movement between a closed position forming with said rear and bottom walls an enclosed space and an open position providing access to said enclosed space, said closure member having a horizontally extending edge defining the other said sealing lip which when said closure member in said closed position is spaced from said one lip to define said open slot through which said sheet layer passes; said housing means further comprising a pair of end caps mounted at opposing ends of said rear and bottom walls and said closure member and comprising means for mounting said roller in said enclosed space with a generally vertical tangent therefrom lying adjacent said other lip when said closure member is in said closed position to position said sheet layer in contact with said other lip when said sheet layer is in its closed position.

* * * * *

UNITED STATES PATENT AND TRADEMARK OFFICE

CERTIFICATE OF CORRECTION

PATENT NO. : 4,368,771

DATED : January 18, 1983

INVENTOR(S) : THOMAS P. HOPPER

It is certified that error appears in the above-identified patent and that said Letters Patent is hereby corrected as shown below:

Column 1

Line 36, change "Se" to --See--.

Column 2

Line 52, change "know" to --known--,

Line 68, change "on" to --one--.

Column 3

Line 42, between "having" and "leading", insert --a--.

Column 6

Line 56, between "80b" and "a", insert --,--.

Column 9

Line 10, change "by", first occurrence, to --be--.

Column 12

Line 2, delete "emitted by a surface to that",

Line 7, change "by" to --be--.

UNITED STATES PATENT AND TRADEMARK OFFICE

CERTIFICATE OF CORRECTION

PATENT NO. : 4,368,771 Page 2 of 2

DATED : January 18, 1983

INVENTOR(S) : THOMAS P. HOPPER

It is certified that error appears in the above-identified patent and that said Letters Patent is hereby corrected as shown below:

Column 20

Line 7, between "cap" and "received", insert --being--.

Signed and Sealed this

Ninth Day of August 1983

[SEAL]

*Attest:*

GERALD J. MOSSINGHOFF

*Attesting Officer* *Commissioner of Patents and Trademarks*